US007059825B2

(12) United States Patent
Magowan et al.

(10) Patent No.: US 7,059,825 B2
(45) Date of Patent: Jun. 13, 2006

(54) COOLED ROTOR BLADE

(75) Inventors: John W. Magowan, Longmeadow, MA (US); David Krause, Tolland, CT (US); Frank Thomas Cucinella, Rocky Hill, CT (US); Raymond C. Surace, Newington, CT (US); Shawn J. Gregg, Wethersfield, CT (US); Dominic J. Mongillo, Jr., West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 129 days.

(21) Appl. No.: 10/855,149

(22) Filed: May 27, 2004

(65) Prior Publication Data

US 2005/0265841 A1 Dec. 1, 2005

(51) Int. Cl.
*F01D 5/18* (2006.01)

(52) U.S. Cl. ..... 415/115

(58) Field of Classification Search ..... 416/97 R, 416/96 R; 415/115
See application file for complete search history.

(56) References Cited

U.S. PATENT DOCUMENTS 5,700,131 A * 12/1997 Hall et al. ..... 416/97 R
6,139,269 A * 10/2000 Liang ..... 416/97 R
6,565,318 B1 * 5/2003 Tiemann ..... 416/97 R
6,634,858 B1 * 10/2003 Roeloffs et al. ..... 416/97 R
6,932,570 B1 * 8/2005 Heyward et al. ..... 416/97 R
2004/0202542 A1 * 10/2004 Cunha et al. ..... 416/97 R

OTHER PUBLICATIONS

The reference is a redacted copy of a blueprint of a turbine blade, part No. 54L401, dated May 27, 1988.

* cited by examiner

*Primary Examiner*—Edward K. Look
*Assistant Examiner*—Nathan Wiehe
(74) *Attorney, Agent, or Firm*—Colin L. Cini

(57) ABSTRACT

A rotor blade is provided having a hollow airfoil with a cavity and an attached root. The root has a leading edge conduit, at least one mid-body conduit, and a trailing edge conduit. Each conduit has a centerline. The leading edge conduit includes an inlet having a forward side, a suction side, and a pressure side that diverge from the centerline of the leading edge conduit, and an aft side. Each of the mid-body conduits includes an inlet having a suction side and a pressure side that diverge from the centerline of the mid-body conduit, and an aft side and a forward side. The trailing edge conduit includes an inlet having a suction side and a pressure side that diverge from the centerline of the trailing edge conduit. The trailing edge conduit inlet further includes a forward side and an aft side.

14 Claims, 2 Drawing Sheets

FIG.1
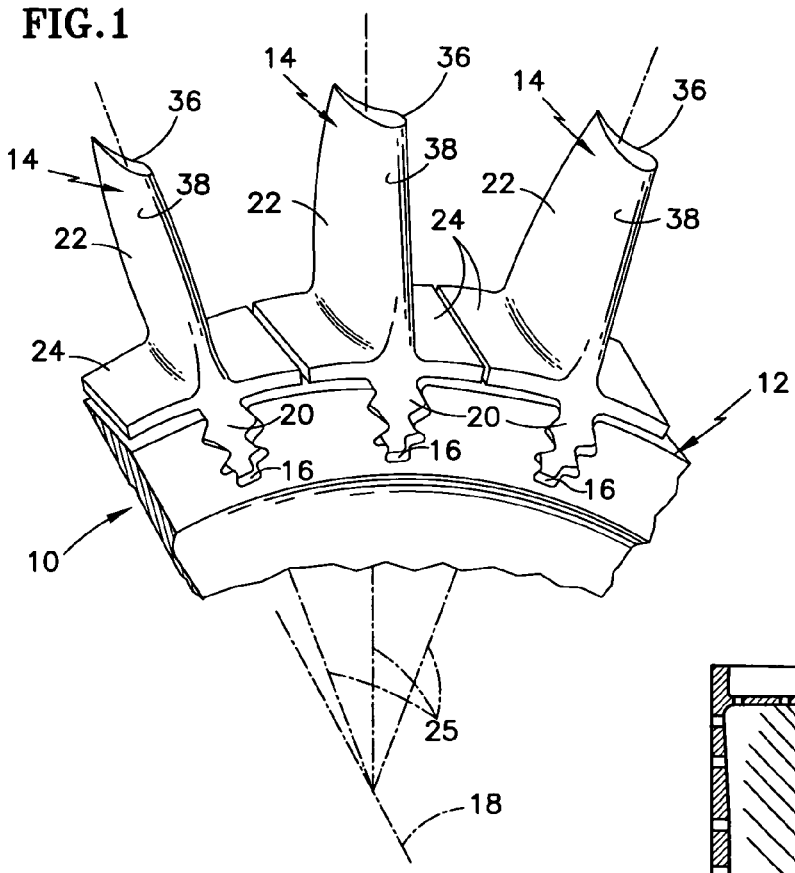
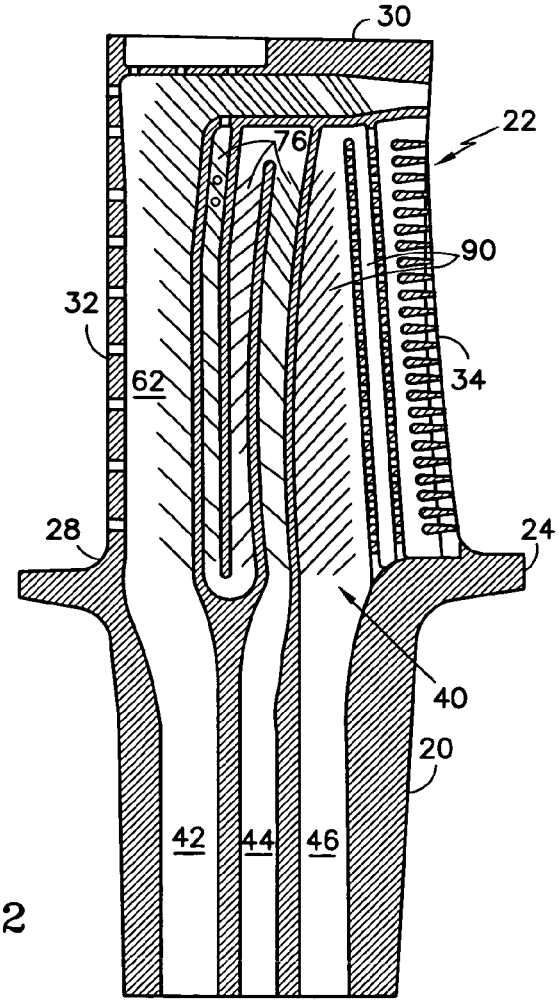
FIG.2

COOLED ROTOR BLADE

BACKGROUND OF THE INVENTION

1. Technical Field

This invention applies to gas turbine rotor blades in general, and to cooled gas turbine rotor blades in particular.

2. Background Information

Turbine sections within an axial flow turbine engine include rotor assemblies that include a disc and a number of rotor blades. The disk includes a plurality of recesses circumferentially disposed around the disk for receiving the blades. Each blade includes a root, a hollow airfoil, and a platform. The root includes conduits through which cooling air may enter the blade and pass through into a cavity within the hollow airfoil. The blade roots and recesses are shaped (e.g., a fir tree configuration) to mate with one another to retain the blades to the disk. The mating geometries create a predetermined gap between the base of each recess and the base of the blade root. The gap enables cooling air to enter the recess and pass into the blade root.

Airflow pressure differences propel cooling air into and out of the rotor blade. Relatively high pressure cooling air is typically bled off of a compressor section. The energy imparted to that air enables the requisite cooling, but does so at a cost since that energy is no longer available to create thrust within the engine. Hence, it is desirable to minimize the amount of energy that is necessary to provide cooling within a rotor blade.

The gas path pressure external to a rotor blade airfoil is highest at the leading edge region during operation of the blade. In many turbine applications, airfoils are typically backflow margin limited at the leading edge of the airfoil. The term "backflow margin" refers to the ratio of internal pressure to external pressure. To ensure hot gases from the external gas path do not flow into an airfoil, it is necessary to maintain a particular predetermined backflow margin that accounts for expected internal and external pressure variations. Hence, it is desirable to minimize pressure drops within the airfoil to the extent possible, particularly with respect to passages providing airflow to cool the leading edge.

It is known to use conduits within a blade root having a bellmouth inlet; i.e., an inlet that is flared on the leading edge ("forward") side, suction side, pressure side, and the trailing edge ("aft") side. A disadvantage of this approach is that the bellmouth inlet decreases the size of the root material that extends between the suction side and pressure side, between adjacent conduits. During operation, the blade root is highly loaded between the suction and pressure sides. Decreasing the cross-sectional area of root material between the suction and pressure sides undesirably decreases the ability of the root to handle the load.

What is needed is a rotor blade that requires less energy to be adequately cooled relative to prior art rotor blades, one that requires less energy for cooling by reducing pressure losses within the rotor blade relative to prior art rotor blades, and one that can adequately handle the attachment loading within the root.

DISCLOSURE OF THE INVENTION

According to the present invention, a rotor blade is provided having a hollow airfoil and a root. The hollow airfoil has a cavity and one or more cooling apertures. The root is attached to the airfoil, and has a leading edge conduit, at least one mid-body conduit, and a trailing edge conduit.

The conduits are operable to permit cooling airflow through the root and into the cavity. Each conduit has a centerline. The leading edge conduit includes an inlet having a forward side, a suction side, and a pressure side that diverge from the centerline of the leading edge conduit, and an aft side. Each of the mid-body conduits includes an inlet having a suction side and a pressure side that diverge from the centerline of the mid-body conduit, and an aft side and a forward side. The trailing edge conduit includes an inlet having a suction side and a pressure side that diverge from the centerline of the trailing edge conduit, and a forward side and an aft side.

One of the advantages of the present rotor blade is that airflow pressure losses within the blade root are decreased relative to many prior art blade root configurations of which we are aware.

Another advantage of the present invention is that airflow pressure losses are achieved without compromising blade root load capability. Prior art root conduits having bellmouth inlets decreased the pressure loss for cooling air entering the root conduits, but did so at the expense of blade root load capability. The present invention provides the advantageous flow characteristics without appreciably negatively affecting the blade root load capability.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic perspective view of the rotor assembly section.

FIG. 2 is a diagrammatic view of a sectioned rotor blade.

DETAILED DESCRIPTION OF THE INVENTION

Figure 3:
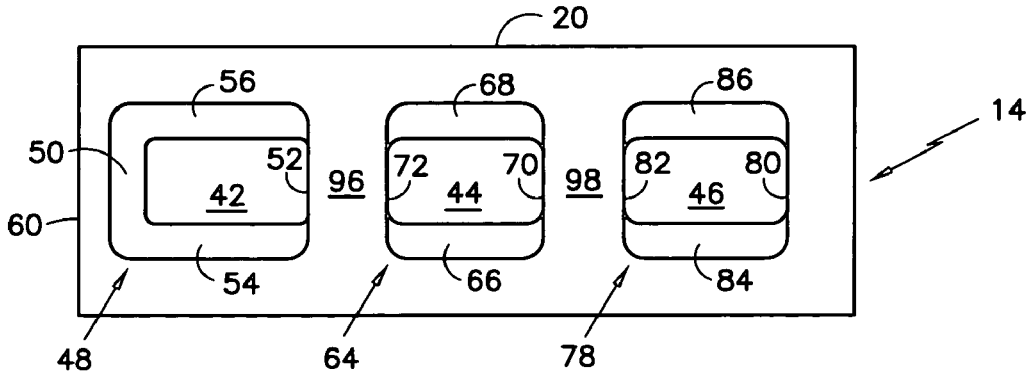
FIG. 3 is a diagrammatic bottom view of a rotor blade root, illustrating an embodiment of the root conduits.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 18 about which the disk 12 may rotate. Each blade 14 includes a root 20, an airfoil 22, a platform 24, and a radial centerline 25. The root 20 includes a geometry (e.g., a fir tree configuration) that mates with that of one of the recesses 16 within the disk 12.

Referring to FIG. 2, the airfoil 22 includes a base 28, a tip 30, a leading edge 32, a trailing edge 34, a pressure-side wall 36 (see FIG. 1), and a suction-side wall 38 (see FIG. 1), and a cavity 40. FIG. 2 diagrammatically illustrates an airfoil 22 sectioned between the leading edge 32 and the trailing edge 34. The pressure-side wall 36 and the suction-side wall 38 extend between the base 28 and the tip 30 and meet at the leading edge 32 and the trailing edge 34.

The root 20 has a leading edge conduit 42, at least one mid-body conduit 44, and a trailing edge conduit 46. The conduits 42, 44, 46 are operable to permit airflow through the root 20 and into the cavity 40. Each conduit 42, 44, 46 has a centerline 58,74,88.

Figure 4:
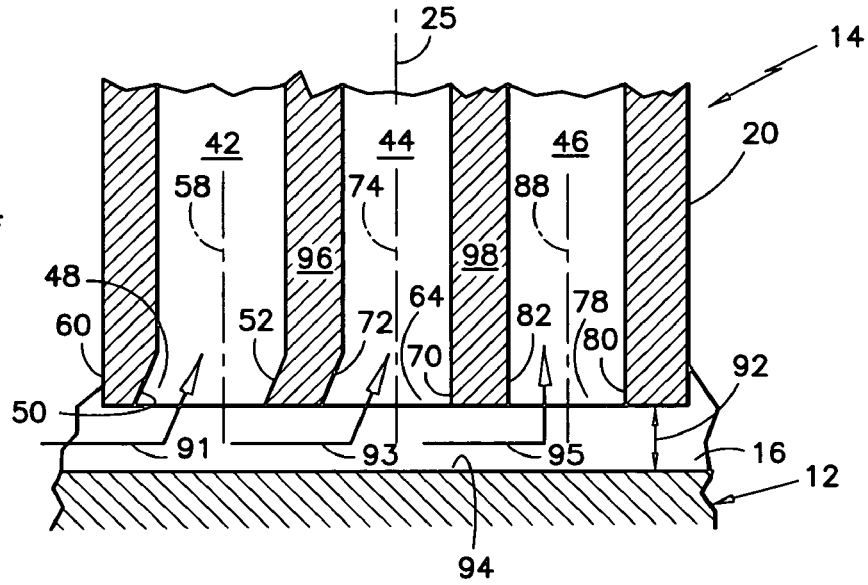
FIG. 4 is a diagrammatic sectional view of a rotor blade mounted within a disk recess, illustrating an embodiment of the root conduits.
Figure 5:
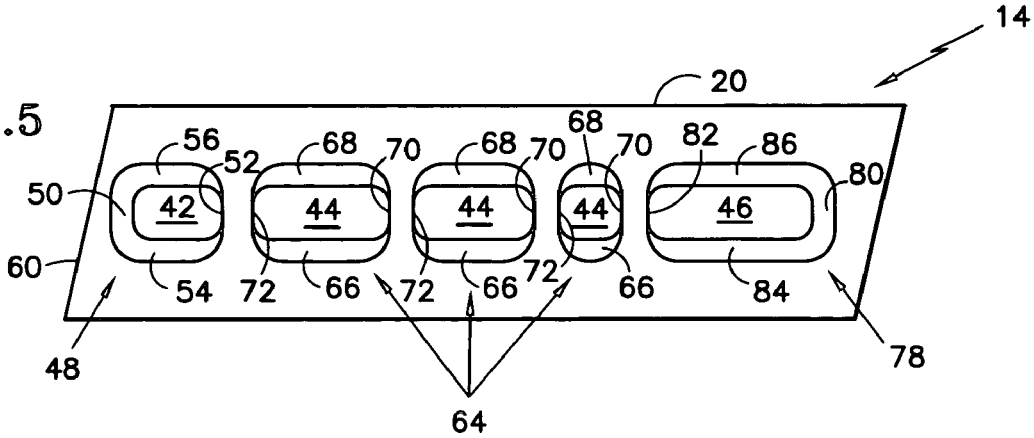
FIG. 5 is a diagrammatic bottom view of a rotor blade root, illustrating an embodiment of the root conduits.

Referring to FIGS. 2-5, the leading edge conduit 42 includes an inlet 48 having a forward side 50, an aft side 52, a suction side 54, and a pressure side 56. The forward, suction, and pressure sides 50, 54, 56 each diverge from the centerline 58 of the leading edge conduit 42. In some embodiments, the forward side 50 diverges at a different angle than the suction and pressure sides 54, 56. In a preferred embodiment, the forward side 50 diverges at a greater angle than the suction and pressure sides 54, 56. In some embodiments, the aft side 52 is substantially parallel to the centerline 58 of the leading edge conduit 42 (FIG. 3). In other embodiments, the aft side 52 converges toward the leading edge end 60 of the root 20 (FIG. 4). In FIG. 4, the aft side 52 is diagrammatically shown as substantially parallel to the forward side 50.

The leading edge conduit 42 is in fluid communication with one or more leading edge passages 62 disposed within the cavity 40, adjacent the leading edge 32 of the airfoil 22. The leading edge conduit 42 provides the primary path into the leading edge passage(s) 62 for cooling air, and therefore the airfoil leading edge 32 is primarily cooled by the cooling air that enters the airfoil 22 through the leading edge conduit 42.

The mid-body conduit(s) 44 includes an inlet 64 having a suction side 66, a pressure side 68, an aft side 70, and a forward side 72. The suction and pressure sides 66, 68 each diverge from the centerline 74 of the mid-body conduit 44. In some embodiments, the aft and forward sides 70, 72 are substantially parallel to the centerline 74 of the mid-body conduit 44 (FIG. 3). In other embodiments, the forward side 72 diverges toward the leading edge end 60 of the root 20 (FIG. 4). In FIG. 4, the forward side 72 of the mid-body conduit 44 is shown as substantially parallel to the aft side 52 of the leading edge conduit 42.

The mid-body conduit(s) 44 is in fluid communication with one or more mid-body passages 76 disposed within the cavity 40. The mid-body conduit 44 provides the primary path into the mid-body passages 76 for cooling air, and therefore the airfoil 22 mid-body region is primarily cooled by the cooling air that enters the airfoil 22 through the mid-body conduit 44.

The trailing edge conduit 46 includes an inlet 78 having an aft side 80, a forward side 82, a suction side 84, and a pressure side 86. The suction and pressure sides 84, 86 each diverge from the centerline 88 of the trailing edge conduit 46. In some embodiments, the aft and forward sides 80, 82 are substantially parallel to the centerline 88 of the trailing edge conduit 46 (e.g., FIGS. 3 and 4). In some embodiments (e.g., FIG. 5), the aft side 80 diverges from the centerline 88 of the trailing edge conduit 46

The trailing edge conduit 46 is in fluid communication with one or more passages 90 disposed within the cavity 40, adjacent the trailing edge 34 of the airfoil 22. The trailing edge conduit 46 provides the primary path into the passages 90 for cooling air. Consequently, the trailing edge 34 is primarily cooled by cooling air that enters the airfoil 22 through the trailing edge conduit 46.

Referring to FIG. 4, in the operation of the invention the rotor blade root 20 is received within a recess 16 disposed within the disk 12. Cooling air 91 enters the gap 92 between the blade root 20 and base 94 of the recess 16, traveling in a direction that is approximately perpendicular to the radial centerline 25 of the blade 14. The cooling airflow 91 first encounters the leading edge end 60 of the root 20, and subsequently the leading edge conduit 42. The forward side 50 of the leading edge conduit 42 facilitates the transition of cooling airflow into the leading edge conduit 42, and thereby lowers the pressure drop associated with the turn in cooling airflow relative to that which would be associated, for example, with a 90° turn. The divergent suction and pressure sides 54, 56 open the inlet 48 to facilitate cooling airflow entry from the sides.

Cooling air 93 that travels past the leading edge conduit 42 encounters the one or more mid-body conduits 44. The divergent suction and pressure sides 66, 68 open the inlet 64 to facilitate cooling airflow entry from the sides, and to decrease the pressure drop for cooling airflow turning into the inlet 46 from the sides. In the embodiment that includes a mid-body conduit inlet 64 with a divergent forward side 72, the inlet 64 forward side 72 facilitates the transition of cooling airflow into the mid-body conduit 44 as described above. Both embodiments of the forward side 72 do not decrease the cross-sectional area of the root portion 96 disposed between the leading edge conduit 42 and the mid-body conduit 44. Consequently, the blade root load capability is not negatively affected, as would be the case if the leading edge and mid-body conduit inlets 48, 64 flared toward one another.

Cooling air 95 that travels past the mid-body conduit 44 encounters the trailing edge conduit inlet 78. The divergent suction and pressure sides 84, 86 open the inlet to facilitate cooling airflow entry from the sides, and to decrease the pressure drop for cooling airflow turning into the inlet 78 from the sides. In the embodiment that includes a trailing edge conduit inlet 78 with a divergent forward side 82, the inlet forward side 82 facilitates the transition of cooling airflow into the trailing edge conduit 46 as described above. Both embodiments of the trailing edge conduit forward side 82 do not decrease the cross-sectional area of the root portion 98 extending between the mid-body conduit 44 and the trailing edge conduit 46. Consequently, the blade root load capability is not negatively affected, as would be the case if mid-body and trailing edge conduit inlets 64, 78 flared toward one another.

Although this invention has been shown and described with respect to the detailed embodiments thereof, it will be understood by those skilled in the art that various changes in form and detail thereof may be made without departing from the spirit and the scope of the invention.

What is claimed is:

1. A rotor blade, comprising:

a hollow airfoil having a cavity, and one or more cooling apertures;

a root attached to the airfoil, the root having a leading edge conduit, at least one mid-body conduit, and a trailing edge conduit, wherein the conduits are operable to permit airflow through the root and into the cavity, and each conduit has a centerline;

wherein the leading edge conduit includes an inlet having a forward side, a suction side, and a pressure side that each diverge from the centerline of the leading edge conduit, and an aft side that is substantially parallel to the centerline of the leading edge conduit;

wherein each of the at least one mid-body conduits includes an inlet having a suction side and a pressure side that each diverge from the centerline of the mid-body conduit, and an aft side that is substantially parallel to the centerline of the mid-body conduit; and wherein the trailing edge conduit includes an inlet having a suction side and a pressure side, that each diverge from the centerline of the trailing edge conduit, and a forward side that is substantially parallel to the centerline of the trailing edge conduit.

2. The rotor blade of claim 1, wherein the trailing edge conduit inlet also has an aft side and the aft side of the trailing edge conduit diverges from the centerline of the trailing edge conduit.

3. The rotor blade of claim 1, wherein the forward side of the leading edge conduit inlet diverges at a different angle than the suction side and the pressure side of the leading edge conduit inlet.

4. The rotor blade of claim 3, wherein the forward side of the leading edge conduit inlet diverges at a greater angle than the suction side and the pressure side of the leading edge conduit inlet.

5. The rotor blade of claim 1, wherein the trailing edge conduit inlet also has an aft side and the aft side of the trailing edge conduit inlet is substantially parallel to the centerline of the trailing edge conduit.

6. The rotor blade of claim 1, wherein each of the at least one mid-body conduit inlets also has a forward side and the forward side of the mid-body conduit inlet is substantially parallel to the centerline of the mid-body conduit.

7. A rotor blade, comprising:

a hollow airfoil having a cavity, and one or more cooling apertures;

a root attached to the airfoil, the root having a leading edge conduit, at least one mid-body conduit, and a trailing edge conduit, wherein the conduits are operable to permit airflow through the root and into the cavity, and each conduit has a centerline;

wherein the leading edge conduit includes an inlet having a forward side, a suction side, and a pressure side that each diverge from the centerline of the leading edge conduit, and an aft side that converges from the centerline of the leading edge conduit;

wherein each of the at least one mid-body conduits includes an inlet having a suction side and a pressure side that each diverge from the centerline of the mid-body conduit, and an aft side that is substantially parallel to the centerline of the mid-body conduit; and wherein the trailing edge conduit includes an inlet having a suction side and a pressure side, that each diverge from the centerline of the trailing edge conduit, and a forward side that is substantially parallel to the centerline of the trailing edge conduit.

8. The rotor blade of claim 7, wherein the trailing edge conduit inlet also has an aft side and the aft side of the trailing edge conduit inlet diverges from the centerline of the wailing edge conduit.

9. The rotor blade of claim 7, wherein each of the at least one mid-body conduit inlets also has a forward side and the forward side of the mid-body conduit inlet diverses from the centerline of the mid-body conduit.

10. The rotor blade of claim 7, wherein the trailing edge conduit inlet also has an aft side and the aft side of the trailing edge conduit inlet is substantially parallel to the centerline of the trailing edge conduit.

11. The rotor blade of claim 7, wherein each of the at least one mid-body conduit inlets also has a forward side and the forward side of the mid-body conduit inlet is substantially parallel to the centerline of the mid-body conduit.

12. The rotor blade of claim 7, wherein the forward side of the leading edge conduit inlet diverges at a different angle than the suction side and the pressure side of the leading edge conduit inlet.

13. The rotor blade of claim 12, wherein the forward side of the leading edge conduit inlet diverges at a greater angle than the suction side and the pressure side of the leading edge conduit inlet.

14. The rotor blade of claim 7, wherein at least one mid-body conduit inlet also has a forward side and the forward side of the mid-body conduit inlet is substantially parallel to the aft side of the leading edge conduit inlet.

* * * * *